US008517325B2

(12) United States Patent
Verma et al.

(10) Patent No.: US 8,517,325 B2
(45) Date of Patent: Aug. 27, 2013

(54) ADAPTOR BAND

(75) Inventors: Saurabh Verma, Fayetteville, GA (US); Jared Davis, Newnan, GA (US); Jason Q. Paulsel, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 759 days.

(21) Appl. No.: 12/633,645

(22) Filed: Dec. 8, 2009

(65) Prior Publication Data

US 2011/0134650 A1 Jun. 9, 2011

(51) Int. Cl.
*F21V 17/00* (2006.01)

(52) U.S. Cl.
USPC ..... 248/342; 362/362

(58) Field of Classification Search
USPC ..... 248/560, 346.03, 346.04, 342, 343, 248/344; 362/362, 368, 370
See application file for complete search history.

(56) References Cited

U.S. PATENT DOCUMENTS 3,130,949 A * 4/1964 Wolff et al. ..... 248/343
3,872,296 A * 3/1975 Cohen et al. ..... 362/366
5,031,084 A 7/1991 Russo et al.
6,082,878 A * 7/2000 Doubek et al. ..... 362/365
6,322,036 B1 * 11/2001 Tame et al. ..... 248/429
6,582,106 B2 * 6/2003 Jamison ..... 362/396
6,612,531 B2 * 9/2003 Wu ..... 248/317
6,780,050 B1 * 8/2004 Wu ..... 439/544
7,364,323 B2 * 4/2008 Francois ..... 362/267
7,993,037 B1 * 8/2011 Buse ..... 362/365
2008/0106907 A1 5/2008 Trott et al.

* cited by examiner

*Primary Examiner* — Steven Marsh
(74) *Attorney, Agent, or Firm* — King & Spalding LLP

(57) ABSTRACT

An adaptor band is flexible, C-shaped, and includes a torsion spring receiver. Additionally, the adaptor band includes one or more slots for receiving a screw to fasten the adaptor band to an internal surface of a pre-existing light housing. The adaptor band is compressed and inserted within the pre-existing housing that does not have torsion spring receivers already therein. Once inserted, the adaptor band is released, thereby expanding and pushing against the internal surface of the housing. The adaptor band is fastened to the internal surface of the housing without having to hold the adaptor band in a fixed position. The torsion spring receivers receive torsion springs coupled to other lighting components, including light modules and trim modules.

21 Claims, 3 Drawing Sheets

ADAPTOR BAND

TECHNICAL FIELD

The present invention relates generally to lighting devices and more particularly to a lighting device with an adaptor band having torsion spring receivers.

BACKGROUND

A significant percentage of electricity that is generated in the United States goes towards lighting applications. Incandescent lamps have been in use for over one hundred years, and still remain in widespread use. These incandescent lamps, although relatively inexpensive and easy to replace, are not very efficient at generating light. As the demand for and the cost of generating electricity has risen over the years, utility companies and other governmental agencies have begun promoting the use of more efficient ways to generate light. Fluorescent light bulbs are more efficient than incandescent light bulbs but are still less efficient that solid state light emitters, such as light emitting diodes ("LEDs").

However, replacing the entire light fixture with a new light fixture can be expensive, especially when several light fixtures need to be replaced. Instead, it would be more economical to replace just the light module of the preexisting light fixture with a different light module, thereby saving costs. However, some new light modules require torsion spring receivers within the housing of the preexisting fixture, which were not originally provided. In view of the foregoing, and for at least the reasons mentioned above, there is a need in the art to develop ways in which to retrofit existing light housings to receive torsion springs.

SUMMARY

According to one exemplary embodiment, the apparatus includes a material strip, a first torsion spring receiver, a second torsion spring receiver, and a coupling means. The material strip includes a front surface and a rear surface. The first torsion spring receiver is positioned at a first location on the material strip, while the second torsion spring receiver is positioned at a second location on the material strip, which is different than the first location. The first and second torsion spring receivers extend inwardly from the front surface. The coupling means couples the material strip to a housing.

According to another exemplary embodiment, the luminaire includes a housing and an adaptor band coupled to an inner surface of the housing. The housing includes the inner surface and an opening at a first end. The adaptor band includes a material strip, a first torsion spring receiver, a second torsion spring receiver, and a coupling means. The material strip includes a front surface and a rear surface. The first torsion spring receiver is positioned at a first location on the material strip, while the second torsion spring receiver is positioned at a second location on the material strip, which is different than the first location. The first and second torsion spring receivers extend inwardly from the front surface. The coupling means couples the material strip to a housing.

According to another exemplary embodiment, a method for installing an adaptor band includes providing an adaptor band, inserting the adaptor band into a luminaire housing, and coupling the adaptor band to an inner surface of the housing. The adaptor band has a first diameter and includes a material strip, a first torsion spring receiver, a second torsion spring receiver, and a coupling means. The material strip includes a front surface and a rear surface. The first torsion spring receiver is positioned at a first location on the material strip, while the second torsion spring receiver is positioned at a second location on the material strip, which is different than the first location. The first and second torsion spring receivers extend inwardly from the front surface. The coupling means couples the material strip to a housing.

BRIEF DESCRIPTION OF THE DRAWINGS

The foregoing and other features and aspects of the invention are best understood with reference to the following description of certain exemplary embodiments, when read in conjunction with the accompanying drawings, wherein.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The present invention is directed to lighting devices that include an adaptor band having torsion spring receivers capable of receiving torsion springs. Although the description of exemplary embodiments is provided below in conjunction with torsion springs coupled to a light module or a reflector trim, the torsion springs are also capable of being coupled to any other component associated with a lighting device, for example, a lens, without departing from the scope and spirit of the exemplary embodiment. Additionally, although the description of exemplary embodiment is provided below in conjunction with an adaptor band that is able to be coupled to a housing's inner surface having a nominal diameter ranging from about 6⅛ inch to about 6⅞ inch, the adaptor band can be re-dimensioned to fit a housing's inner surface having different nominal diameters without departing from the scope and spirit of the exemplary embodiment of the invention.

Figure 1A:
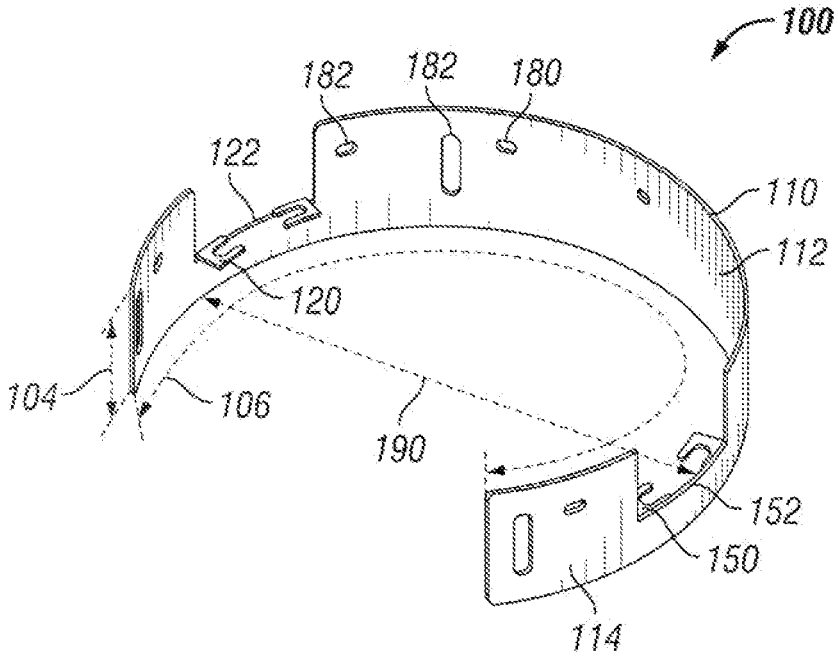
FIG. 1A is a perspective view of an adaptor band in a steady-state condition in accordance with an exemplary embodiment of the present invention.
Figure 1B:
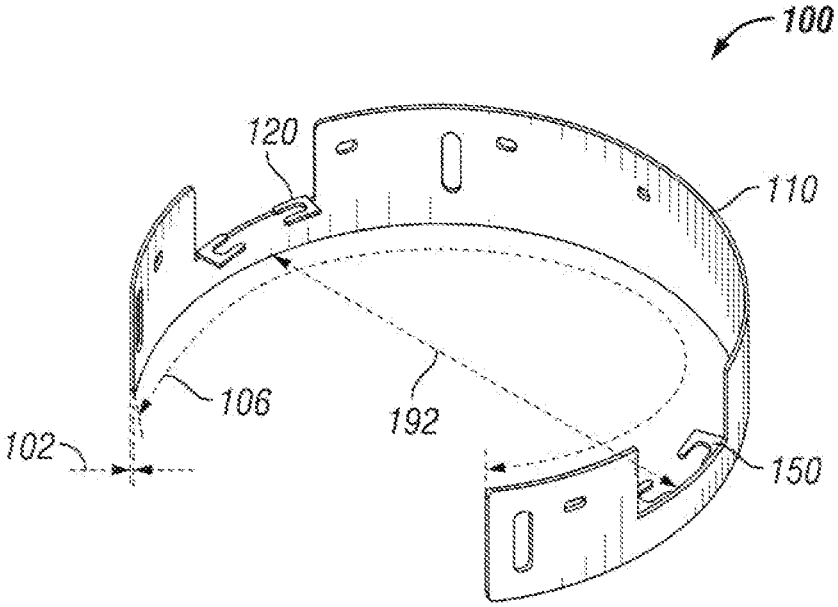
FIG. 1B is a perspective view of the adaptor band of FIG. 1A in a compressed condition in accordance with an exemplary embodiment of the present invention.

The invention is better understood by reading the following description of non-limiting, exemplary embodiments with reference to the attached drawings, wherein like parts of each of the figures are identified by like reference characters, and which are briefly described as follows. FIG. 1A is a perspective view of an adaptor band 100 in a steady-state condition in accordance with an exemplary embodiment of the present invention. FIG. 1B is a perspective view of the adaptor band of FIG. 1A in a compressed condition in accordance with an exemplary embodiment of the present invention. Referring to FIGS. 1A and 1B, the adaptor band 100 includes a material strip 110, a first torsion spring receiver 120 positioned at a first location 122, a second torsion spring receiver 150 positioned at a second location 152, and a coupling means 180 for coupling the material strip 110 to the inner surface 220 (FIG. 2) of a housing 210 (FIG. 2). The coupling means 180 includes, but is not limited to, adhesives and slots, which will further be described below, without departing from the scope and spirit of the exemplary embodiment of the invention.

In one exemplary embodiment, the material strip 110 is a strip of 301 stainless steel metal that is half-hardened and includes a front surface 112 and a rear surface 114. In this example, the material strip has a thickness 102 of about one millimeter, a width 104 of about 1¾ inch at the widest point, and a full arc length 106 of about seventeen inches. The exemplary dimensions provided above allow the adaptor band 100 to be coupled to a housing having a nominal inside diameter 205 (FIG. 2) ranging from about 6⅛ inches to about 6⅞ inches. However, the thickness 102, the width 104, and the full arc length 106 are variable, such that increasing or decreasing one or more will still allow the adaptor band 100 to be coupled to the housing's inner surface 220 (FIG. 2) having the nominal inside diameter 205 ranging from about 6⅛ inches to about 6⅞ inches without departing from the scope and spirit of the exemplary embodiment of the invention. For example, the full arc length 106 ranges from about ten inches to about twenty-two inches and is still able to be coupled to the inner surface 220 having. a nominal inside diameter 205 ranging from about 6⅛ inches to about 6⅞ inches. The thickness 102 ranges from about ¼ millimeter to about five millimeters. The width 104 ranges from about ½ inch to about six inches. In alternative exemplary embodiments, the dimensions for the thickness 102, width 104, and full arc length 106 are variable beyond the ranges provided depending upon the size of the nominal inside diameter 205. Although the exemplary material strip 110 is fabricated from 301 stainless steel, other metals, metal alloys, polymers, or any other suitable material known to people having ordinary skill in the art may be used in fabricating the strip 110.

In one exemplary embodiment, the material strip 110 is flexible, substantially C-shaped, and has a first diameter 190 determinable while the material strip 110 is in a steady-state condition (uncompressed and unexpanded). The material strip 110 is compressible to a range of diameters, including a second diameter 192, as shown in FIG. 1B, which is smaller than the nominal inside diameter 205 (FIG. 2). In one exemplary embodiment, compressing the material strip 110 is achieved by adding force around the perimeter of the material strip 110. Once the force applied to the perimeter of the material strip 110 is removed, the material strip 110 returns to having substantially the first diameter 190, so long as the material strip 110 is not constrained. Although the material strip 110 is described as being substantially C-shaped, other shapes for the material strip 110 are within the scope and spirit of the exemplary embodiment including, but not limited to any circular-type shape ranging from semi-circular to a full circle. In an alternative embodiment, the material strip 110 is substantially flat and subsequently shaped to fit the shape of the housing's inner surface 220 (FIG. 2).

The first torsion spring receiver 120 is positioned on the material strip 110 at a first location 122 and extends inwardly from the front surface 112. In one exemplary embodiment, the first torsion spring receiver 120 is integrally fabricated with the material strip 110. Alternatively, the receiver 120 is separately formed and attached to the material strip 110 using known attachment means including, but not limited to, welding, adhesives, and rivets. When integrally forming the first torsion spring receiver 120, a portion of the material strip 110 is cut, folded over, and formed into the first torsion spring receiver 120. When separately forming the first torsion spring receiver 120, the first torsion spring receiver 120 or portions of the first torsion spring receiver 120 are initially formed and thereafter coupled to the material strip 110 using the attachment means.

The first location 122 is positioned at the centerpoint of the first torsion spring receiver 120 when positioned on the material strip 110. In this exemplary embodiment, the first location 122 is positioned at an arc length of about 5.1 inches from the midpoint between the first location 122 and the second location 152 along the arc length of the material strip 106. The ends of the first torsion spring receiver 120 are substantially U-shaped and face one another. Alternatively, the first torsion spring receiver 120 has other end shapes capable of receiving and securing torsion springs including, but not limited to, L-shaped ends. Additionally, although the first location 122 is positioned at an arc length of about 5.1 inches from the midpoint between the first location 122 and the second location 152, in alternative embodiments, the first location 122 is positioned at an are length that is greater or less than 5.1 inches from the midpoint between the first location 122 and the second location 152 along the arc length of the material strip 106, depending upon the size of the housing's nominal inside diameter 205 (FIG. 2) for which the adaptor band 100 is designed.

Similarly, the second torsion spring receiver 150 is positioned on the material strip 110 at a second location 152 and extends inwardly from the front surface 112 so that it substantially extends toward the first torsion spring receiver 120. In one exemplary embodiment, the second torsion spring receiver 150 is integrally fabricated with the material strip 110. Alternatively, the receiver 150 is separately formed and subsequently attached to the material strip 110 using known attachment means including, but not limited to, welding, adhesives, and rivets. In one exemplary method, when integrally forming the second torsion spring receiver 150, a portion of the material strip 110 is cut, folded over, and formed into the second torsion spring receiver 150. When separately forming the second torsion spring receiver 150, the second torsion spring receiver 150 or portions of the second torsion spring receiver 150 are initially formed and thereafter coupled to the material strip 110 using known attachment means.

The second location 152 is positioned at the centerpoint of the second torsion spring receiver 150 when positioned on the material strip 110. In this exemplary embodiment, the second location 152 is positioned at an arc length of about 5.1 inches from the midpoint between the first location 122 and the second location 152 along the arc length of the material strip 106. The ends of the second torsion spring receiver 150 are substantially U-shaped and face one another. Alternatively, the second torsion spring receiver 150 has other end shapes capable of receiving and securing torsion springs including, but not limited to, .L-shaped ends. Additionally, although the second location 152 is positioned at an arc length of about 5.1 inches from the midpoint between the first location 122 and the second location 152, in alternative embodiments, the second location 152 is positioned at an arc length that is greater or less than 5.1 inches from the midpoint between the first location 122 and the second location 152 along the arc length of the material strip 106, depending upon the size of the housing's nominal inside diameter 205 (FIG. 2) for which the adaptor band 100 is designed.

The coupling means 180 couples the material strip 110 to the housing's inner surface 220 (FIG. 2). According to this exemplary embodiment, the coupling means 180 includes one or more slots 182 positioned along the length of the material strip 110. The slots 182 extend vertically, horizontally, or concentrically along the material strip length and provide an aperture therethrough. The vertical orientation of the slots 182 provide the ability to vary the vertical position of the material strip 110 once coupled to the housing's internal surface 220 (FIG. 2). Alternatively, or in addition to the vertical slots, the slots 182 include horizontally oriented slots that assist in varying the horizontal positioning of the material strip 110 once coupled to the housing's internal surface 220 (FIG. 2). In another alternative embodiment, the slots 182 are concentrically shaped, thereby fixedly positioning the material strip 110 once coupled to the housing's internal surface 220 (FIG. 2). The slots 182 are sized to receive a fastener (not shown) for coupling the material strip 110 to the housing 210 along its internal surface 220 (FIG. 2). Examples of the fastener includes, but is not limited to, a screw, nail, rivet, or other device known to people having ordinary skill in the art. Although one type of coupling means has been described for coupling the material strip 110 to the housing 210, alternative coupling means include, but are not limited to, an adhesive placed on at least a portion of the material strip's rear surface 114 or along the internal surface 220 of the housing 210.

Figure 2A:
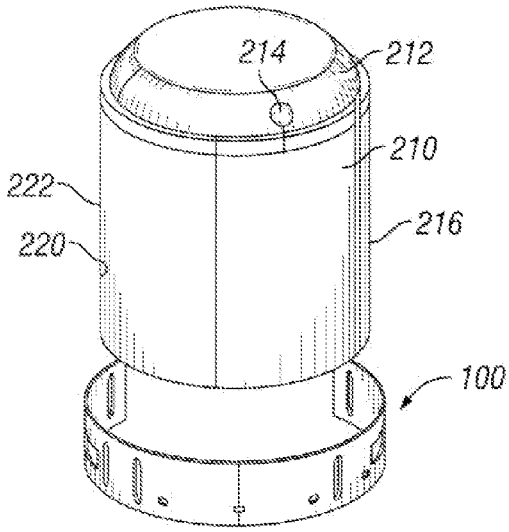
FIG. 2A is an exploded view of a housing and the adaptor band of FIG. 1A in accordance with an exemplary embodiment of the present invention.
Figure 2B:
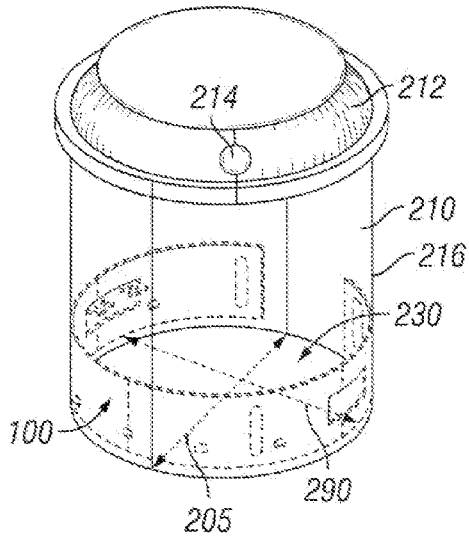
FIG. 2B is a perspective view of the adaptor band installed within the housing in accordance with an exemplary embodiment of the present invention.

FIG. 2A is an exploded view of the housing 210 and the adaptor band 100 of FIG. 1A in accordance with an exemplary embodiment of the present invention. FIG. 2B is a perspective view of adaptor band 100 installed within the housing 210 in accordance with an exemplary embodiment of the present invention. Referring to FIGS. 1A, 1B, 2A and 2B, the housing 210 includes a dome-shaped top 212 and a circular-shaped cylindrical wall 216 extending downward from the dome-shaped top 212.

The dome-shaped top 212 includes a passageway 214 extending from the interior of the housing 210 to the exterior of the housing 210. The passageway 214 is sized to allow electrical wires (not shown) to proceed through the passageway 214 and supply a light module 400 (FIG. 4) with power. In one exemplary embodiment, the wires are electrically coupled to a junction box (not shown) that is positioned near the exterior of the housing 210. In some exemplary embodiments, the dome-shaped top 212 is optional. Although one exemplary embodiment uses a dome-shaped top 212, the top can be any geometric or non-geometric shape, for example, a flat-top, without departing from the scope and spirit of the exemplary embodiment of the invention.

The cylindrical wall 216 has a cylindrical or substantially cylindrical cross-section and includes the internal surface 220 and an external surface 222. The internal surface 220 and the external surface 222 are both substantially circular. However, in certain alternative exemplary embodiments, the internal surface 220 and the external surface 222 can be any other geometric or non-geometric shape. One end of the wall 216 is coupled to the dome-shaped top 212, while the opposing end defines an opening 230, which provides an illumination pathway for a light source (not shown). The opening 230 also is substantially circular. However, in certain alternative embodiments, the opening 230 has a non-circular shape that corresponds to the shape of the external surface 222.

The adaptor band 100 is positioned adjacent the opening 230 and compressed so that the diameter of the adaptor band 100 becomes a second diameter 192, which is less than the housing's nominal inside diameter 205. The adaptor band 100 is inserted through the opening 230 so that it is surrounded by the internal surface 220. The adaptor band 100 is released and it expands, thereby changing the diameter of the adaptor band 100 from the second diameter 192 to a third diameter 290. Since the adaptor band 100 is positioned and constrained within the internal surface 220, the third diameter 290 is substantially similar to the nominal inside diameter 205. The adaptor band 100 is adjusted within the internal surface 220 so that the first torsion spring receiver 120 and the second torsion spring receiver 150 are substantially within the same plane and are, for example, about 170-190 degrees apart from one another. Additionally, the adaptor band 100 is oriented so that the first torsion spring receiver 120 and the second torsion spring receiver 150 are about 1¼ inches from the opposing end of the housing 210, which defines the opening 230. In alternative exemplary embodiments, the first torsion spring receiver 120 and the second torsion spring receiver 150 range from about ½-4 inches from the opposing end of the housing 210. In certain exemplary embodiments, a longitudinal edge of the adaptor band 100 is aligned with and positioned adjacent to the opposing end of the housing 210 that defines the opening 230.

Once the adaptor band 100 is properly oriented within the housing 210, the adaptor band 100 applies an outward force against the internal surface 220, thereby creating a friction fit between the adaptor band 100 and the internal surface 220. Thus, the adaptor band 100 is stable and unmovable within the housing 210 without application of additional force on the adaptor band 100. Accordingly, the adaptor band 100 is capable of being fastened to the housing's internal surface 220 with fasteners without having to use a hand or other device to hold the adaptor band 100 in place. One or more fasteners including, but not limited to, metal piercing screws, other types of screws, nails, or rivets are used to securely couple the adaptor band 100 to the internal surface 220. As previously mentioned, an adhesive including, but not limited to, a glue, cement, or Velcro® can be placed on the adaptor band's rear side 114 to facilitate coupling between the rear side 114 and the internal surface 220.

Figure 3:
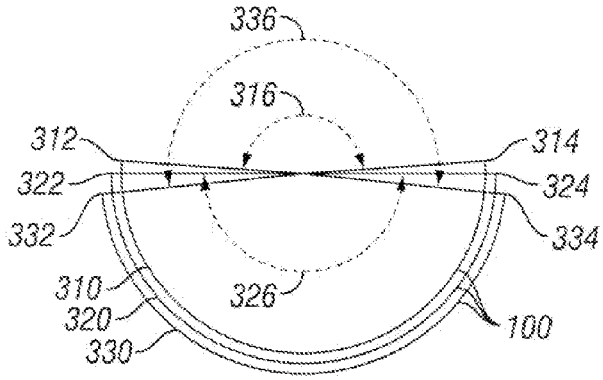
FIG. 3 is a top view of the adaptor band positioned in three different compression states in accordance with an exemplary embodiment of the present invention.

FIG. 3 is a top view of the adaptor band 100 positioned in three different compression states 310, 320, and 330 in accordance with an exemplary embodiment of the present invention. Referring to FIGS. 1A, 2A, 213, and 3, the adaptor band 100 is designed to be inserted within the housing 210, which has a nominal inside diameter 205. In one exemplary embodiment, the nominal inside diameter ranges from 6⅛-6⅞ inches. However, as previously mentioned, the length and size of the adaptor band 100 is modifiable to fit housings having different nominal inside diameters without departing from the scope and spirit of the exemplary embodiment of the invention.

The adaptor band 100 is in a first compression state 310 when inserted and properly oriented within the housing 210 having a nominal inside diameter 205 of about 6⅛ inches. When in the first compression state 310, a first compression angle 316 is formed between the centerpoint 312 of the first torsion spring receiver 120 and the centerpoint 314 of the second torsion spring receiver 150. The first compression angle 316 is about 170 degrees. The adaptor band 100 is in a second compression state 320 when inserted and properly oriented within the housing 210 having a nominal diameter 205 of about 6½ inches. When in the second compression state 320, a second compression angle 326 is formed between the centerpoint 322 of the first torsion spring receiver 120 and the centerpoint 324 of the second torsion spring receiver 150. The second compression angle 326 is about 180 degrees. The adaptor band 100 is in a third compression state 330 when inserted and properly oriented within the housing 210 having a nominal diameter 205 of about 6⅞ inches. When in the third compression state 330, a third compression angle 336 is formed between the centerpoint 332 of the first torsion spring receiver 120 and the centerpoint 334 of the second torsion spring receiver 150. The third compression angle 336 is about 190 degrees. This adaptor band 100 is designed to receive torsion springs that are coupled to a device, wherein the torsion springs are at an angle ranging from about 170 degrees to about 190 degrees between one another. However, the angle between the centerpoint of the first torsion spring receiver 120 and the centerpoint of the second torsion spring receiver 150 can vary from the description provided above depending upon the angle formed between the torsion springs on the device that the torsion springs are coupled to.

Figure 4:
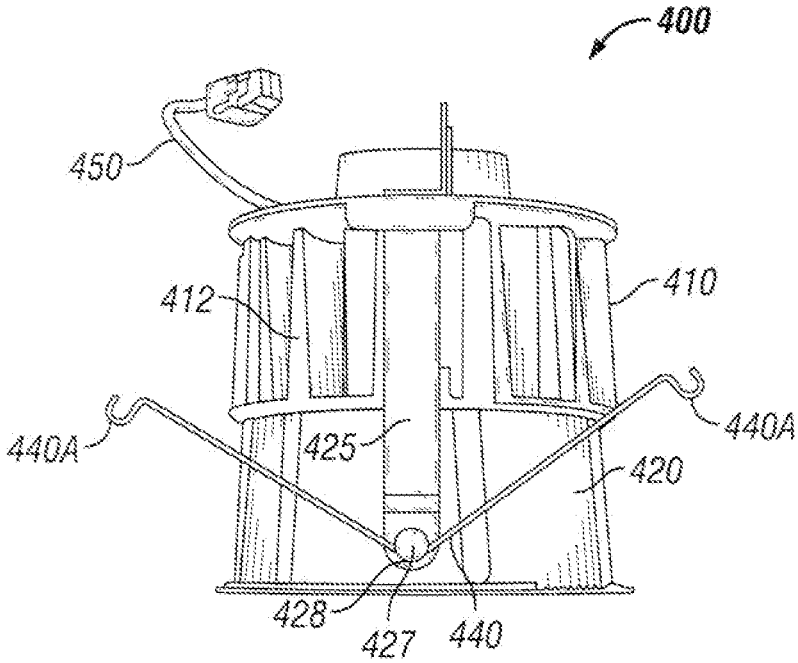
FIG. 4 is a perspective view of a light module in accordance with an exemplary embodiment of the present invention.

FIG. 4 is a perspective view of a light module 400 in accordance with an exemplary embodiment of the present invention. The light module 400 is described in detail within U.S. patent application Ser. No. 12/235,116, titled "Light Emitting Diode Recessed Light Fixture," which was filed on Sep. 22, 2008, and is incorporated by reference herein. Referring to FIG. 4, the light module 400 includes a heat sink 410, a reflector 420, at least one torsion spring 440, an electrical wire 450, and a light source (not shown) thermally coupled to the heat sink 410. The light module 400 is designed for installation within the housing 210 (FIG. 2A). In the exemplary embodiment, the light source is an LED package. Although the LED package is used as a light source in the exemplary embodiment, the other options for a light source include, but are not limited to, an incandescent lamp, a high intensity discharge ("HID") lamp, a compact fluorescent lamp ("CFL"), a halogen lamp, a fluorescent lamp, or a combination of light sources. In one exemplary embodiment, the LED package is mounted directly to a bottom surface of the heat sink 410. Alternatively, the LED package is thermally coupled to the bottom surface of the heat sink 410 with one or more other components mounted in between the LED package and the heat sink 410.

According to the exemplary embodiment, the heat sink 410 has a substantially circular profile with one or more fins 412 extending outwardly from a central area of the heat sink 410. The fins 412 can be evenly spaced about the outer perimeter of the heat sink 410. In alternative exemplary embodiments, the profile of the heat sink 410 can vary without departing from the scope and spirit of the exemplary embodiment of the invention. The heat sink 410 manages heat output from the light source. The heat sink 410 is fabricated form any material capable of conducting and/or convecting heat, such as die cast metal.

The reflector 420 also has a substantially circular profile and is coupled to the heat sink 410 at one end using one or more fasteners (not shown), such as screws, clips, nails, pins, and rivets. The reflector 420 is fabricated from a material capable of reflecting, refracting, transmitting, or diffusing light that is emitted from the light source.

Torsion springs 440 are coupled to the side surfaces of the reflector 420 using a mounting bracket 425. Typically, two torsion springs 440 are mounted about 180 degrees form one another, however, a different number of torsion springs 440 can be mounted and at different angles from one another. Accordingly, in these alternative embodiments, the adaptor band 110 (FIG. 1A) would be redesigned to accept these alternative torsion spring configurations. The mounting bracket 425 is coupled to the reflector using one or more screws, nails, snaps, clips, pins, and/or other fastening devices known to a person having ordinary skill in the art. The mounting bracket 425 includes an aperture 428 that receives a rivet 427 or other fastening device for mounting one of the torsion springs 440 to the reflector 420. Although one method is described for mounting torsion springs 440 to the reflector 420, other methods known to people having ordinary skill in the art can be used for coupling torsion springs to the reflector without departing from the scope and spirit of the exemplary embodiment.

Each torsion spring 440 includes opposing bracket ends 440*a* that are inserted inside corresponding torsion spring receivers 120 and 150 (FIG. 1A) that are positioned on the adaptor band 100 (FIG. 1A). To install the light module 400 in the housing 210 (FIG. 2A), the bracket ends 440*a* are squeezed together, the light module 400 is slid into the cavity of the housing 210 (FIG. 2A), and the bracket ends 440*a* are aligned with the torsion spring receivers 120 and 150 (FIG. 1A) and then released such that the bracket ends 440*a* enter the torsion spring receivers 120 and 150 (FIG. 1A). The electrical wiring 450 is electrically coupled to other electrical wiring that provides power supply to the light module 400. The electrical coupling between the electrical wiring 450 and the other electrical wiring can occur either within or exterior of the housing 210 (FIG. 2A). Although one exemplary embodiment has been described for the light module 400, other types of light modules having torsion springs can be used for coupling with the adaptor band 100 (FIG. 1A) without departing from the scope and spirit of the exemplary embodiment of the invention.

Figure 5:
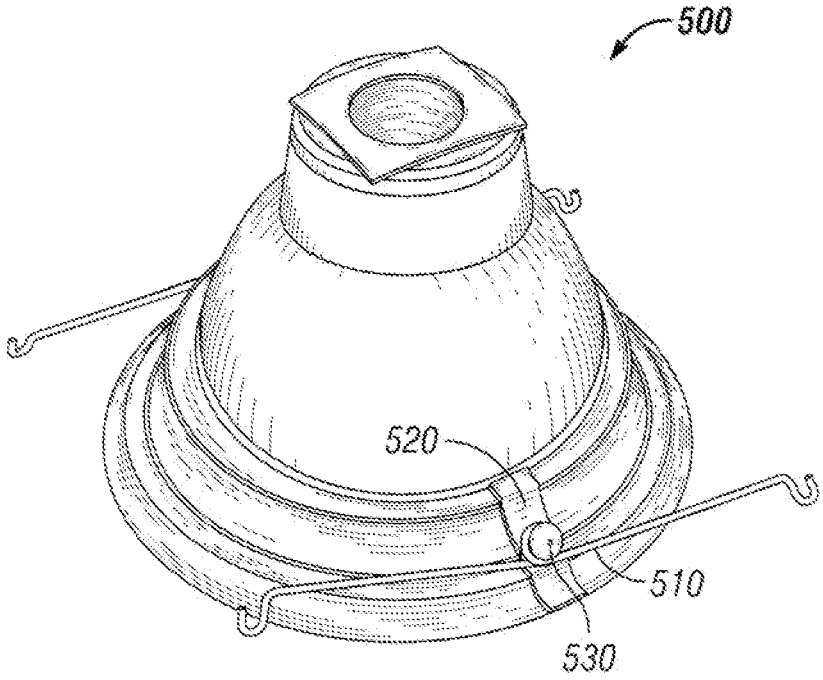
FIG. 5 is a perspective view of a reflector in accordance with an exemplary embodiment of the present invention.

FIG. 5 is a perspective view of a reflector 500 in accordance with an exemplary embodiment of the present invention. The reflector 500 has a substantially conical profile and is fabricated from a material capable of reflecting, refracting, transmitting, or diffusing light that is emitted from a light source. Although the reflector in this exemplary embodiment has a conical profile, alternative exemplary embodiments can have a reflector with a different profile. The reflector 500 includes two torsion springs 510 which are coupled to the reflector 500 in a similar manner as described above with respect to the coupling of the torsion springs 440 (FIG. 4) to the light module 400. Each torsion spring 510 is coupled to the reflector 500 using a mounting bracket 520 and a rivet 530. However, other methods known to people having ordinary skill in the art can be used for coupling torsion springs to the reflector. Each torsion spring 510 is inserted into the torsion spring receivers 120 and 150 (FIG. 1A) according to the description provided above. Although a light module having torsion springs and a reflector having torsion springs have been described herein, other devices having torsion springs, for example, a lens, can be used for coupling with the adaptor band without departing from the scope and spirit of the exemplary embodiment.

Although each exemplary embodiment has been described in detail, it is to he construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes or the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. An apparatus for installing a downlight module, the apparatus comprising:

a recessed light fixture housing;

a material strip comprising a front surface and a rear surface;

a first torsion spring receiver positioned on the material strip at a first location, the first torsion spring receiver extending inwardly from the front surface;

a second torsion spring receiver positioned on the material strip at a second location different from the first location, the second torsion spring receiver extending inwardly from the front surface; and a coupling means for coupling the material strip to an inner surface of the recessed light fixture housing, wherein the coupling means comprises one or more slots positioned along a length of the material strip, the one or more slots providing a passageway through the material strip, wherein the material strip is positioned inside the recessed light fixture housing, and wherein the first torsion spring receiver and the second torsion spring receiver are at an angle ranging from about 170 to 190 degrees apart once the rear surface is coupled to the inner surface of the recessed light fixture housing and wherein the angle corresponds to a positioning of at least two torsion springs located on the downlight module.

2. The apparatus of claim 1, wherein the slots comprise vertical slots disposed along the length of the material strip.

3. The apparatus of claim 1, wherein the slots comprise horizontal slots disposed along the length of the material strip.

4. The apparatus of claim 1, wherein the coupling means further comprises an adhesive coupled to at least a portion of the rear surface of the material strip.

5. The apparatus of claim 1, wherein the material strip is flexible.

6. The apparatus of claim 1, wherein at least one of the torsion spring receivers is integrally formed with the material strip.

7. The apparatus of claim 1, wherein at least one of the torsion spring receivers comprises:

a first end; and a second end;

wherein the first end and the second end form an opening therebetween.

8. The apparatus of claim 7, wherein the shape of at least one of the ends is selected from a group consisting of substantially U-shaped and substantially L-shaped.

9. A recessed luminaire, comprising:

a downlight housing comprising an inner surface and an opening at a first end, wherein light is output through the opening in the first end;

an adaptor band coupled to the inner surface of the downlight housing, the adaptor band comprising:

a material strip comprising a front surface and a rear surface;

a first torsion spring receiver positioned on the material strip at a first location, the first torsion spring receiver extending inwardly from the front surface;

a second torsion spring receiver positioned on the material strip at a second location different from the first location, the second torsion spring receiver extending inwardly from the front surface; and a coupling means for coupling the material strip to the inner surface of the downlight housing, the coupling means comprising one or more slots positioned along the length of the material strip, each slot providing an aperture through the material strip, wherein the adaptor band is positioned inside the downlight housing, wherein a first torsion spring and a second torsion spring are configured to attach a downlight module to the downlight housing, wherein a first end of the first torsion spring receiver is sized to receive a first bracket end of the first torsion spring, wherein a second end of the first torsion spring receiver is sized to receive a second bracket end of the first torsion spring, wherein a first end of the second torsion spring receiver is sized to receive a first bracket end of the second torsion spring, and wherein a second end of the second torsion spring receiver is sized to receive a second bracket end of the second torsion spring.

10. The luminaire of claim 9, wherein the first torsion spring receiver and the second torsion spring receiver extend inwardly in a direction substantially towards the other torsion spring receiver.

11. The luminaire of claim 9, wherein the first torsion spring receiver and the second torsion spring receiver extend inwardly in an orientation that is substantially parallel to the opening in the first end.

12. The luminaire of claim 9, wherein the adaptor band is disposed adjacent to the opening in the first end.

13. The luminaire of claim 9, wherein the first torsion spring receiver and the second torsion spring receiver are positioned within the downlight housing at a distance ranging from about ¼ inch to about three inches from the opening in the first end.

14. The luminaire of claim 9, wherein the coupling means comprises an adhesive coupled to at least a portion of the rear surface of the material strip.

15. The luminaire of claim 9, wherein the material strip is substantially C-shaped.

16. The luminaire of claim 9, wherein the first torsion spring receiver and the second torsion spring receiver are at an angle ranging from about 170 degrees apart to about 190 degrees apart once the rear surface is coupled to the inner surface of the downlight housing, wherein the angle corresponds to a positioning of the first torsion spring and the second torsion spring on the downlight module.

17. The luminaire of claim 9, wherein the first torsion spring receiver and the second torsion spring receiver receive the first torsion spring and the second torsion spring respectively, wherein the first torsion spring and the second torsion spring are coupled to a device selected from the group consisting of a light module, a reflector trim, and a lens.

18. The apparatus of claim 9, wherein at least one of the torsion spring receivers comprises:

a first end; and a second end;

wherein the first end and the second end forms an opening therebetween.

19. The apparatus of claim 18, wherein the shape of at least one of the ends is selected from a group consisting of substantially U-shaped and substantially L-shaped.

20. The apparatus of claim 1, wherein each of the first torsion spring receiver and the second torsion spring receiver comprises:

a first end sized to receive a first bracket end of a torsion spring; and a second end sized to receive a second bracket end of the torsion spring.

21. The apparatus of claim 1, wherein the recessed light fixture housing is an existing recessed light fixture housing, wherein the first torsion spring receiver and the second torsion spring receiver are configured to accept first and second torsion springs located on the downlight module while installing the downlight module in the existing recessed light fixture housing.

* * * * *